US008750746B2

(12) United States Patent
Tsuru et al.

(10) Patent No.: US 8,750,746 B2
(45) Date of Patent: Jun. 10, 2014

(54) IMAGE FORMING APPARATUS

(75) Inventors: Kenji Tsuru, Hachioji (JP); Hideyuki Kurahashi, Toyokawa (JP); Teruo Nagashima, Toyohashi (JP); Osamu Okada, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 53 days.

(21) Appl. No.: 13/492,460

(22) Filed: Jun. 8, 2012

(65) Prior Publication Data

US 2012/0321339 A1 Dec. 20, 2012

(30) Foreign Application Priority Data

Jun. 16, 2011 (JP) ..... 2011-134530

(51) Int. Cl.
*G03G 21/20* (2006.01)
*B65H 5/26* (2006.01)

(52) U.S. Cl.
USPC ..... 399/92; 399/107; 399/361; 399/388; 271/9.11; 271/264

(58) Field of Classification Search
USPC ..... 399/92, 107, 361, 388; 358/474, 488; 271/9.11, 264
See application file for complete search history.

(56) References Cited

U.S. PATENT DOCUMENTS 4,757,356 A * 7/1988 Garofalo ..... 399/364
5,615,001 A 3/1997 Kawashima et al.
5,815,787 A * 9/1998 Crayton et al. ..... 399/393
7,146,120 B2 * 12/2006 Ogane et al. ..... 399/92
7,305,201 B2 * 12/2007 Kimura ..... 399/92
7,313,341 B2 * 12/2007 Matsusaka ..... 399/88
2004/0234291 A1 11/2004 Iikawa et al.
2005/0025515 A1 * 2/2005 Funakoshi ..... 399/88
2005/0078341 A1 4/2005 Sawada et al.
2010/0001454 A1 * 1/2010 Okumura et al. ..... 271/97

FOREIGN PATENT DOCUMENTS

JP 05-313428 A 11/1993
JP 08-015935 A 1/1996
JP 08-328334 A 12/1996
JP 2002-214889 A 7/2002

(Continued)

OTHER PUBLICATIONS

Office Action (Notification of Reason(s) for Refusal) issued on Aug. 21, 2013, by the Japanese Patent Office in corresponding Japanese Patent Application No. 2011-134530, and an English Translation of the Office Action. (6 pages).

*Primary Examiner* — David Gray
*Assistant Examiner* — Francis Gray
(74) *Attorney, Agent, or Firm* — Buchanan Ingersoll & Rooney PC

(57) ABSTRACT

A feeder has a longer side direction orthogonal to a conveyance direction of a recording medium, and is configured to feed a maximum size recording medium with a longer side first. An image forming unit has a maximum sheet feed width corresponding to a longer side length of the maximum size recording medium, and is configured to print a toner image corresponding to digital image data onto the recording medium. An electrical component unit is configured to control the feeder and the image forming unit. The image forming unit and the electrical component unit are respectively disposed on both sides of the feeder in a shorter side direction.

6 Claims, 6 Drawing Sheets

(56) References Cited

FOREIGN PATENT DOCUMENTS

| | | | | |
|---|---|---|---|---|
| JP | 2003316237 | A | * | 11/2003 |
| JP | 2004-341374 | A | | 12/2004 |
| JP | 2005-031550 | A | | 2/2005 |
| JP | 2005-115084 | A | | 4/2005 |
| JP | 2012108247 | A | * | 6/2012 |

* cited by examiner

IMAGE FORMING APPARATUS

CROSS-REFERENCE TO RELATED APPLICATIONS

The present application claims priority under 35 U.S.C. §119 to Japanese Patent Application No. 2011-134530, filed Jun. 16, 2011. The contents of this application are incorporated herein by reference in their entirety.

BACKGROUND OF THE INVENTION

1. Field of the Invention

The present invention relates to an image forming apparatus.

2. Discussion of the Background

Electrographic image forming apparatuses include a feeder and an image forming unit. The feeder feeds a recording medium. The image forming unit prints a toner image corresponding to image data onto the recording medium. Generally, printing in the image forming unit is as follows. The toner image on a photoreceptor drum is electrostatically transferred onto the recording medium fed from the feeder by known electrophotography. Then, the recording medium after the transfer is conveyed to a fixing unit to be heated and pressed to have the toner image fixed onto the recording medium.

It is disclosed in each of Japanese Unexamined Patent Application Publication No. 8-328334 and Japanese Unexamined Patent Application Publication No. 2005-115084 that a width of a printable image is determined by the maximum sheet feed width of the image forming unit (the maximum value of a width direction length orthogonal to a conveyance direction of the recording medium). In order to minimize the production cost, it is common practice to set the maximum sheet feed width of the image forming unit at the same size as the size of the shorter side of a maximum recording medium accommodable in the feeder, and to feed the maximum size recording material into the image forming unit on shorter side of the maximum size recording material.

The recent growing consciousness for global environment has created a need for considering environment in relation to production activities in factories and, additionally, a need for environmental loading reduction throughout the life cycle of industrial products. However, the above-described image forming apparatus is only directed to minimizing the production cost and gives no consideration for environmental loading. Additionally, with this configuration, the period of time for printing on a maximum size recording material is as long as traveling along the longer side of the maximum size recording material. This creates a tendency toward a reduced number of printed sheets per unit time. Although this can be addressed by increasing the processing speed of the image forming apparatus, increasing its processing speed in turn increases energy consumption due to increased use of power and develops noise. This can improve environmental loading.

SUMMARY OF THE INVENTION

It is a technical task of the present invention to provide an image forming apparatus which can solve the problems described above.

According to one aspect of the present invention, an image forming apparatus includes a feeder, an image forming unit, and an electrical component unit. The feeder has a longer side direction orthogonal to a conveyance direction of a recording medium, and is configured to feed a maximum size recording medium with a longer side first. The image forming unit has a maximum sheet feed width corresponding to a longer side length of the maximum size recording medium, and is configured to print a toner image corresponding to digital image data onto the recording medium. The electrical component unit is configured to control the feeder and the image forming unit. The image forming unit and the electrical component unit are respectively disposed on both sides of the feeder in a shorter side direction.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
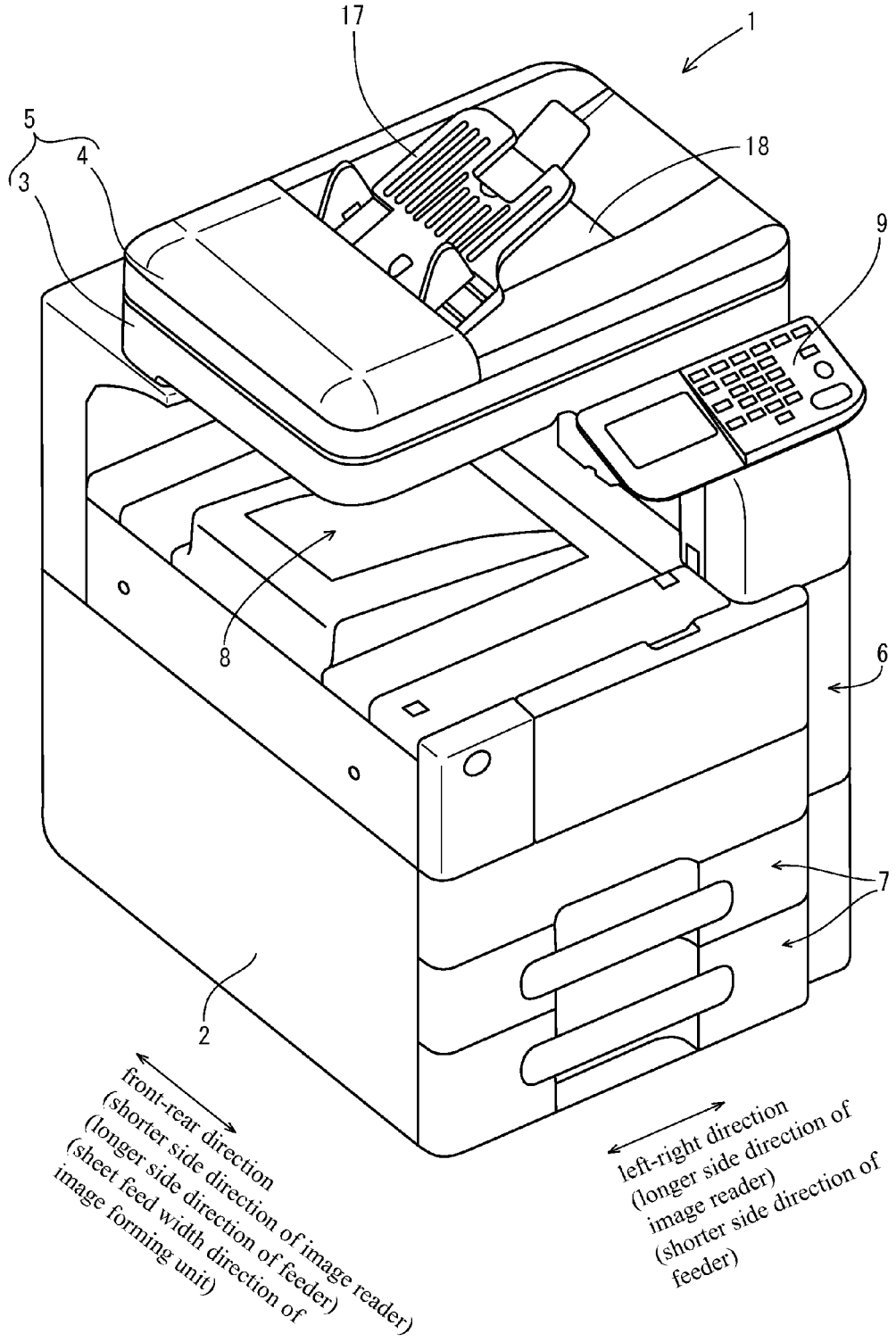
FIG. 1 is a perspective view of an MFP.

An embodiment will now be described with reference to the accompanying drawings, wherein like reference numerals designate corresponding or identical elements throughout the various drawings.

In the following description, terms (for example, "left and right" and "upper and lower") indicating specific directions and positions are used where necessary. These directions and positions are based on the front view shown in FIG. 4, which is the direction orthogonal to the paper plane. The terms are used for the sake of description and will not limit the technical scope of the present invention.

First, an overview of a multi-functional printer 1 (hereinafter, referred to as an MFP) as an example of an image forming apparatus will be described by referring to FIG. 1 to FIG. 3. The MFP 1 has multiple functions including a copying function, a scanning function, a printing function, and a facsimile function, and is capable of data communications through networks (communication networks) such as a LAN and a phone line. Specifically, the MFP 1 is capable of outputting digital image data read from a document and subjected to digital conversion to another computer through a network, or inputting digital image data from another computer through a network and printing the digital image data, or transmitting and receiving FAX data.

An image reader 5 is disposed in an upper portion of a main body 2 of the MFP 1, and includes a scanner 3 and an automatic document feeder 4 (hereinafter referred to as an ADF). The image reader 5 synchronizes the scanner 3 with the ADF 4 so as to optically read an image on each document in the ADF 4, thus acquiring digital image data. Specifically, the ADF 4 conveys documents to the scanner 3 one at a time, and the scanner 3 reads the image on each document when each document passes through a predetermined reading position, thus acquiring digital image data.

A feeder 7 that accommodates recording media P is disposed in a lower portion of the main body 2. An image forming unit 6 is disposed between the image reader 5 and the feeder 7 in the main body 2, and prints a toner image corresponding to digital image data onto the recording media P by known electrophotography. Thus, the image reader 5 is disposed above the image forming unit 6 that is disposed above the feeder 7. The feeder 7 supplies the recording media P to the image forming unit 6 one at a time. The image forming unit 6 prints a toner image onto the recording medium P based on digital image data acquired by the image reader 5 or through a network. In the main body 2, a recessed space between the image reader 5 and the image forming unit 6 serves as a discharged sheet reservoir 8 constituting a discharged sheet space. The discharged sheet reservoir 8 is where the recording medium P having a toner image printed through the image processor 6 is discharged.

An operation panel 9 as an operation unit, which includes a plurality of keys (buttons), is disposed on a front side (forward side) of the main body 2. A user operates the keys by referring to a display screen and the like on the operation panel 9 when the user executes various kinds of setting of a function selected from the various functions of the MFP 1 and instructs the MFP 1 to execute operations.

The MFP 1 is a so-called A4 compatible printer, and can store, in the feeder 7, the recording medium P of A4 size as the maximum size in a lateral feed position to enter the image forming unit 6 with a longer side first. As shown in FIG. 2 and FIG. 3, the feeder 7 includes removable sheet feed cassettes 31, and recording media P are accommodated in a frame body 31*a* of each sheet feed cassette 31. The sheet feed cassette 31 is disposed with the length of the frame body 31*a* in the conveyance direction of the recording medium P being shorter than the length of the frame body 31*a* in the direction orthogonal to the conveyance direction of the recording medium P. Here, the recording medium P of A4 in landscape has a longer side length L (width) of 297 mm and a shorter side length N (conveyance direction length) of 210 mm.

An inner structure of the main body 2 will be described with reference to FIG. 4 and other figures. The scanner 3 of the image reader 5 in the upper portion of the main body 2 includes a platen 11, a light source device 13, an image sensor 14, an imaging lens 15, and a mirror group 16. The platen 11 includes a platen glass 12 (see FIG. 2) on an upper surface side. The light source device 13 irradiates a document D with light. The image sensor 14 photoelectrically converts reflected light from the document D into an image signal. The imaging lens 15 forms an image on the image sensor 14 from the reflected light. The mirror group 16 sequentially reflects the reflected light from the document D to be incident on the imaging lens 15. The platen 11 incorporates the light source device 13, the image sensor 14, the imaging lens 15, and the mirror group 16.

To read the document D on the platen glass 12, the document D is irradiated with light from the light source device 13 moving in the longer side direction (left-right direction of the main body 2) of the image reader 5 together with the mirror group 16. The reflected light from the document D is sequentially reflected by the mirror group 16 to be incident on the imaging lens 15 that in turn forms an image on the image sensor 14 from the reflected light. The image sensor 14 performs photoelectric conversion for each pixel in accordance with the intensity of the incident light to produce an image signal (RGB signal) corresponding to the image on the document D. The image signal (RGB signal) is output to a control board 42 described later.

The ADF 4 is openably disposed on the upper surface side of the platen 11. The ADF 4 also has a function of putting the document D in close contact with the platen glass 12 by being laid on the document D on the platen glass 12. The ADF 4 includes a document placement tray 17 and a document discharge tray 18. To read the document D placed on the document placement tray 17, the document D is conveyed to a reading position by a document conveyance mechanism 19 including a plurality of rollers and the like. During the conveyance, a portion of the document D at the reading position is irradiated with light from the light source device 13. The image is formed on the image sensor 14 from the reflected light through the mirror group 16 and the imaging lens 15. Then, the image sensor 14 converts the reflected light into the image signal (RGB signal) corresponding to the image on the document D, and outputs the image signal to the control board 42. Then, the document D is discharged onto the document discharge tray 18.

To read the document D of A4 size, which is the maximum size, with the image reader 5, the document D is set to have the longer side direction aligned with the left-right direction of the main body 2 as viewed from the front. In other words, the document D is set to have the longer side direction orthogonal to the sheet feed width direction of the image forming unit 6 (front-rear direction of the main body 2). The document D on the document placement tray 17 in the ADF 4 is longitudinally fed in the left-right direction of the main body 2 with the shorter side first. Thus, the longer and shorter side directions of the image reader 5 are respectively aligned with the left-right and front-rear directions of the main body 2.

Figure 4:
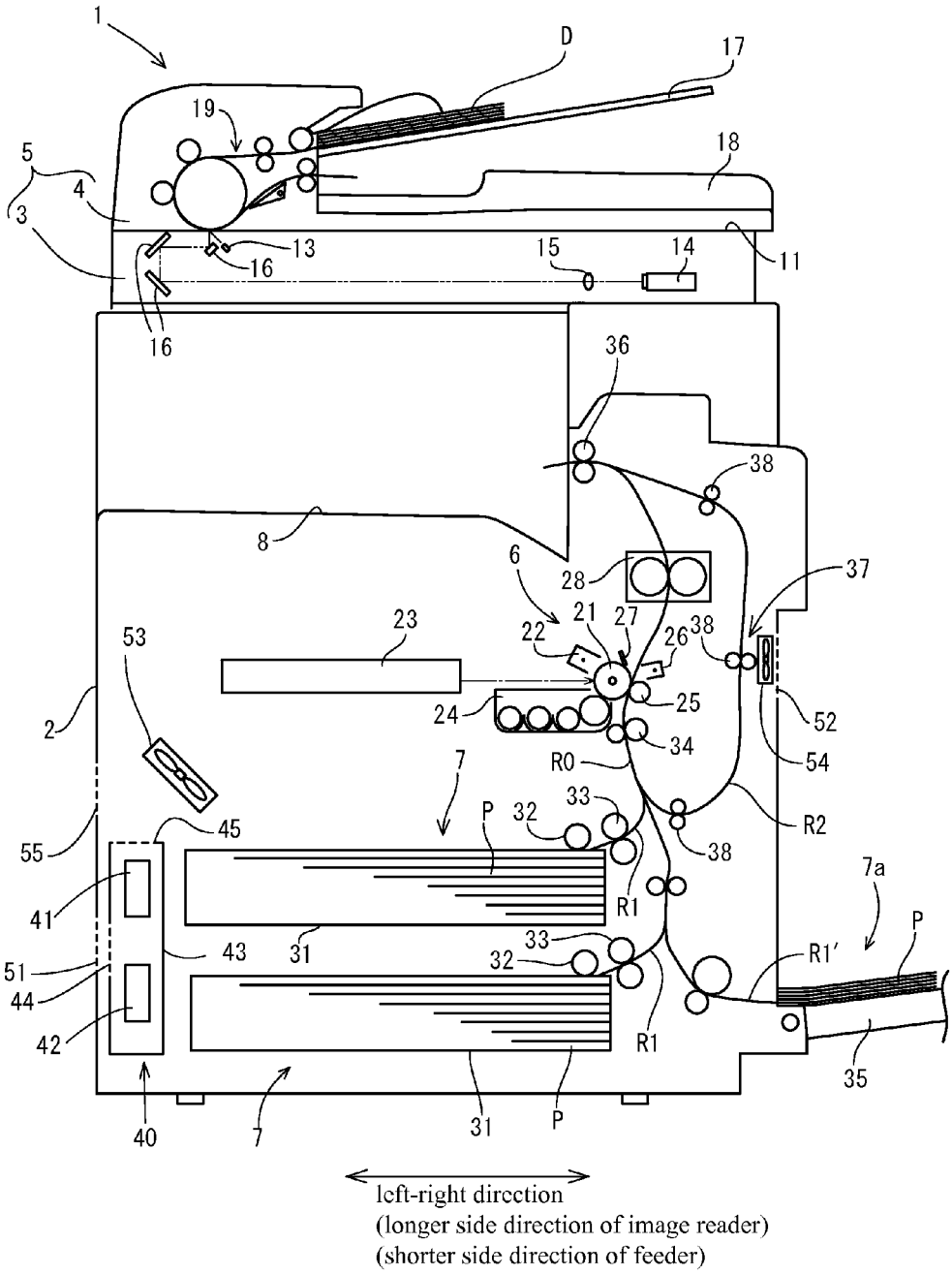
FIG. 4 is a cross-sectional front view of an inner structure of a main body.

As shown in FIG. 4, the image forming unit 6 transfers a toner image formed on a photoreceptor drum 21 as an image carrier onto a recording medium P through a known electrophotography, and conveys the recording medium P after the transfer to a fixing unit 28 to be heated and pressed so that the toner image is fixed onto the recording medium P. Around the photoreceptor drum 21, a charger 22, an exposing unit 23, a developer 24, a transfer roller 25, a separator 26, and a cleaner 27 are arranged in this order in the rotational direction of the photoreceptor drum 21 (in the counterclockwise direction of FIG. 4).

The charger 22 uniformly charges a surface of the photoreceptor drum 21. The exposing unit 23 forms an electrostatic latent image on the surface of the photoreceptor drum 21. The developer 24 develops the electrostatic latent image on the photoreceptor drum 21 into a toner image (visible image). The transfer roller 25 transfers the toner image on the photoreceptor drum 21 onto the recording medium P. The photoreceptor drum 21 and the transfer roller 25 define, at the position of their contact, a transfer position. The separator 26 separates the recording medium P from the photoreceptor drum 21. The cleaner 27 removes un-transferred toner remaining on the photoreceptor drum 21. The maximum sheet feed widths (the maximum value of the width direction length orthogonal to the conveyance direction of the recording medium P) of the photoreceptor drum 21, the transfer roller 25, and the like are slightly larger than the longer side length L (=297 mm) of the recording medium P of A4 in landscape. Thus, the toner image can be transferred onto the recording medium P of A4 in landscape.

The fixing unit 28 includes a fixing roller and a pressure roller. The fixing roller incorporates a fixing heater such as a halogen heater. The pressure roller is opposite the fixing roller. The fixing roller and the pressure roller define, at the portion of their contact, a fixing position. The control board 42 controls power to the fixing heater to keep the fixing heater at a temperature necessary for the fixing. The maximum sheet feed width of the fixing unit 28 is also slightly larger than the longer side length L (=297 mm) of the recording medium P of A4 in landscape. Thus, the recording medium P of A4 in landscape can be heated and pressed. The maximum sheet feed widths of the photoreceptor drum 21, the transfer roller 25, and the like, as well as the fixing unit 28 indicate that, in this embodiment, the maximum sheet feed width of the image forming unit 6 is set to allow the recording medium P of A4 in landscape to be printed.

As shown in FIG. 4, the feeder 7 includes the sheet feed cassettes 31, feeding rollers 32, pairs of separating rollers 33, and pairs of registration rollers 34. The sheet feed cassettes 31 are vertically stacked and each accommodate recording media P. The feeding rollers 32 each feed the recording media P in corresponding one of the sheet feed cassettes 31 one at a time from the top. Each pair of separating rollers 33 separates the picked part of recording media P into individual beets. The pairs of registration rollers 34 determine the timing at which to feed the fed recording media P to the transfer position. The recording media P in each of the sheet feed cassettes 31 are fed to a main conveyance path R0 through a sheet feed path R1 one at a time from the top by the driving rotation of a corresponding set of the feeding rollers 32 and the pair of separating rollers 33. The main conveyance path R0 serves as a main path through which the recording medium P is subjected to the image forming (printing) steps. The sheet feed path R1 is provided to each of the sheet feed cassettes 31. The sheet feed paths R1 each join the main conveyance path R0 on the upstream side of the pair of registration rollers 34 in the conveyance direction.

Figure 2:
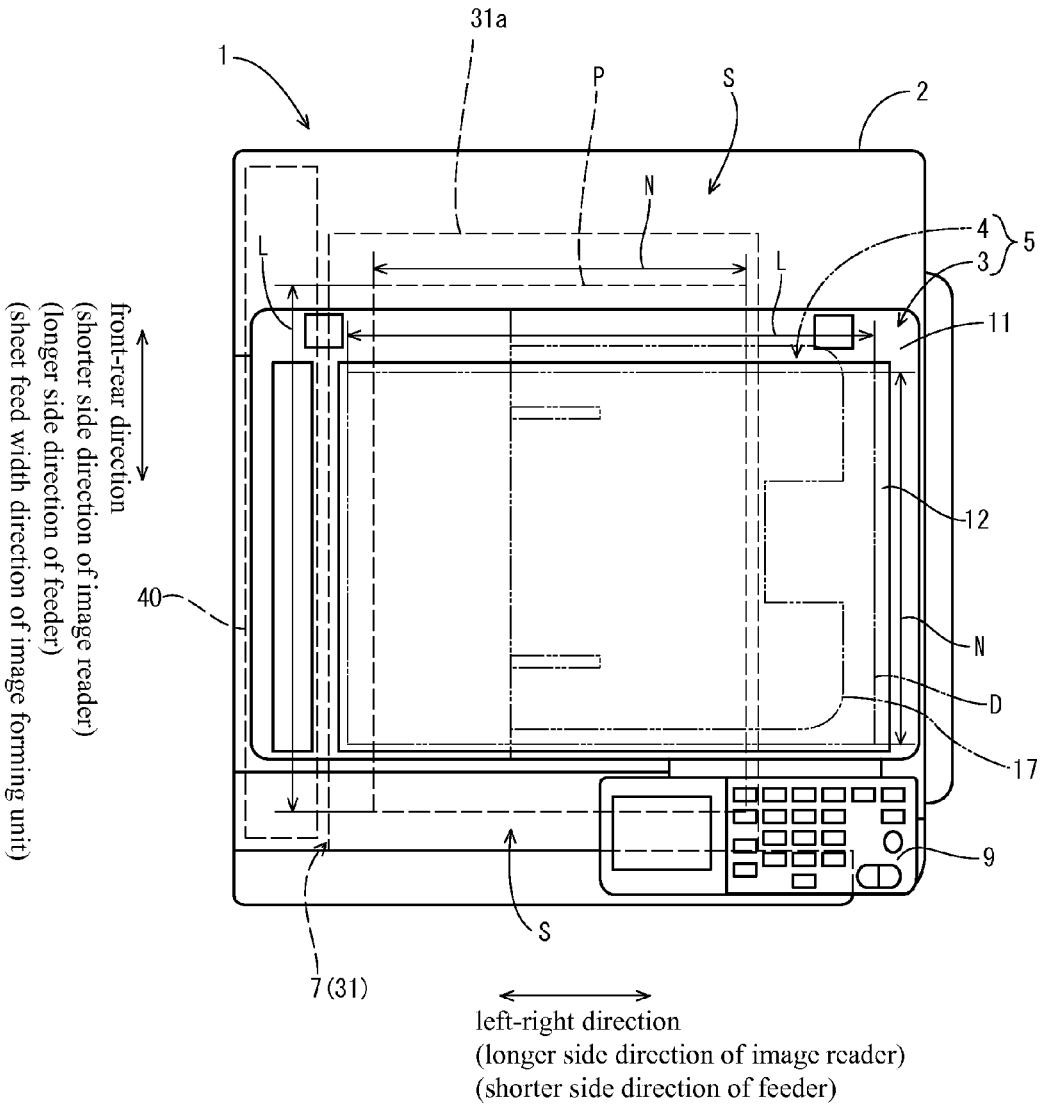
FIG. 2 is a plan view of the MFP without an ADF.

As shown in FIG. 2, the longer side direction of the sheet feed cassette 31 is aligned with the front-rear direction of the main body 2. Thus, the longer side direction of the recording medium P of A4 size accommodated in the sheet feed cassette 31 is aligned with the front-rear direction of the main body 2. Accordingly, the recording medium P of A4 size is laterally fed to the image forming unit 6 with the longer side first.

As shown in FIG. 2, the longer side direction of the sheet feed cassette 31 is orthogonal to the longer side direction of the image reader 5. This also indicates that, in the main body 2, the front-rear length of the upper portion constituting the image reader 5 is shorter than the front-rear length of the lower portion incorporating the sheet feed cassettes 31 and the like. Thus, in the plan view, the lower portion (main body 2) partially overlaps with the upper portion (image reader 5) and sticks out at least from the closer longer side of the upper portion (image reader 5). In this embodiment, due to the appearance of the lower portion (main body 2), open spaces S are respectively formed in front of and behind the upper portion (image reader 5) in the plan view.

Figure 3:
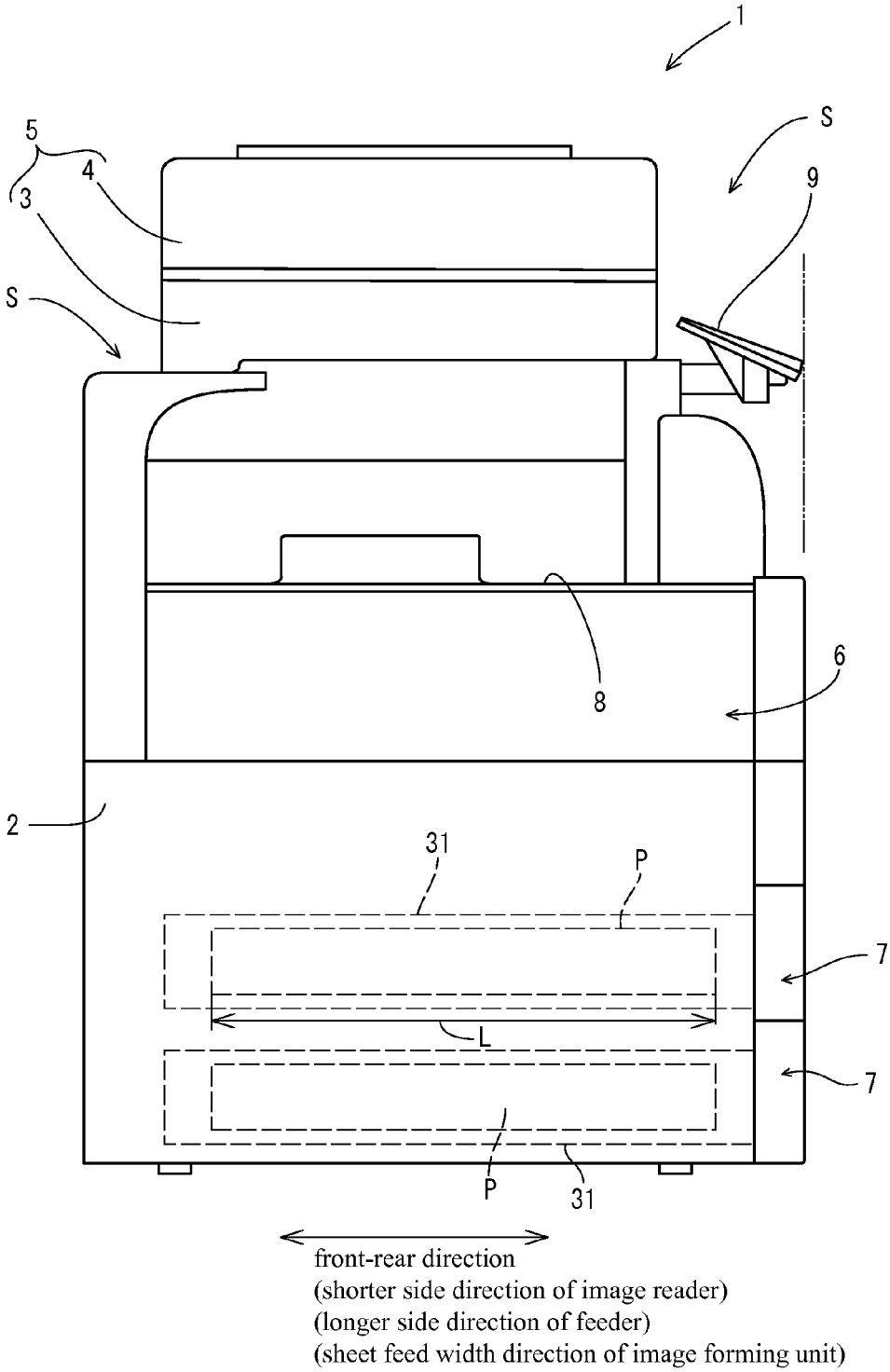
FIG. 3 is a right side view of the MFP.

The operation panel 9 as an operation unit is disposed in the front open space S adjacent to the image reader 5 without sticking out from the outer surface of the one shorter side portion of the feeder 7 along the left-right direction of the main body 2 (forward surface portion in this embodiment) (see FIG. 3). The one shorter side portion of the feeder 7 corresponds to the one shorter side of the recording medium P of A4 size. The operation panel 9 has the front end side located more on the inner side than the forward surface of the main body 2 (feeder 7) and thus is entirely embedded in the front open space S.

As shown in FIG. 4, a pair of discharging rollers 36 are disposed above the image forming unit 6 that is disposed above the feeder 7. The recording medium P is conveyed vertically upward in the main conveyance path R0. Here, the image forming unit 6 is disposed above the one longer side of the sheet feed cassette 31 in the front-rear direction of the main body 2. The one longer side of the sheet feed cassette 31 corresponds to the one longer side of the recording medium P of A4 size. Thus, the image forming unit 6 of this embodiment is offset to the right side in the main body 2. The main conveyance path R0, the pair of discharging rollers 36, and a circulation conveyance unit 37 are also offset to the right side in the main body 2.

As shown in FIG. 4, a manual feeder 7*a* used as a sub-feeder includes a retractable bypass tray 35. Specifically, the bypass tray 35 through which the recording medium P of a predetermined size can be fed from outside is provided on the one side (right side in this embodiment) of the main body 2 in the left-right direction. The bypass tray 35 is provided in addition to the regular feeder 7 in the main body 2, and is pivotably mounted to be opened and closed to the one side of the main body 2 in the left-right direction. The recording media P on the bypass tray 35 is fed to the main conveyance path R0 through a manual sheet feed path R1' one at a time from the top by the driving rotation of a pickup roller and the like.

The maximum sheet feed width of the image forming unit 6 in the MFP 1 corresponds to the longer side length of the recording medium P of A4 in landscape. Thus, the recording medium P of A3 size can be longitudinally fed through the bypass tray 35 to be printed.

The manual feeder 7*a* with a portion on which the recording medium P is placed defined as "placement portion" is formed to satisfy the following condition. Specifically, the length of the placement portion in the direction orthogonal to the conveyance direction of the recording medium P (that is, feeding direction) is the same with the length of the frame body 31*a* of the sheet feed cassette 31 in the direction orthogonal to the conveyance direction of the recording medium P.

The pair of discharging rollers 36 that discharge the printed recording medium P is disposed more on the downstream side than the fixing unit 28 in the main conveyance path R0. The printed recording medium P is discharged onto the discharged sheet reservoir 8 by driving rotation of the pair of discharging rollers 36.

The circulation conveyance unit 37 for reversing the recording medium P having the one side printed for duplex printing is disposed in the main body 2 of this embodiment. The circulation conveyance unit 37 includes a pair of reversing rollers that reverses the recording medium P having the one side printed, and pairs of duplex conveyance rollers 38. In the circulation conveyance unit 37, the recording medium P having the one side printed is reversed and is again conveyed to the pair of registration rollers 34 through a circulation conveyance path R2. Here, the pair of discharging rollers 36 is rotatable back and forth, and thus also serves as the pair of reversing rollers. The back and forth rotation of the pair of discharging rollers 36 allows the recording medium P to be discharged from the MFP 1 and to be switched back (backwardly fed) to return into the MFP 1. The upstream side of the circulation conveyance path R2 is branched off from the main conveyance path R0 at a portion between the fixing unit 28 and the pair of discharging rollers 36. The downstream side of the circulation conveyance path R2 joins the main conveyance path R0 at a portion more on the upstream side than the pair of registration rollers 34.

As shown in FIG. 4, in the main body 2, the image forming unit 6 and an electrical component unit 40 are respectively disposed on both sides of the feeder 7 in shorter side direction. The electrical component unit 40 on the opposite side of the image forming unit 6 across the feeder 7 includes a power source board 41 that controls power to the units (for example, the image reader 5, the image forming unit 6, and the feeder 7) of the main body 2 and the control board 42 in charge of overall control of operations of the units. The power source board 41 and the control board 42 are surrounded by a shield casing 43 formed by shaping a metal plate into a box. With the shield casing 43 surrounding the boards 41 and 42, noise emitted from the boards 41 and 42 is prevented from spreading, and the grounding of the boards 41 and 42, and the like is improved.

As described above, the image forming unit 6 of this embodiment is above the right longer side of the uppermost sheet feed cassette 31. The electrical component unit 40 is located on the left side of the left longer side portion of the sheet feed cassette 31. Here, the shield casing 43 has a shape of a box that is long in the upper-lower and front-rear directions and short in the left-right direction. The shield casing 43 is vertically installed on the left side of the left longer side of the sheet feed cassette 31. The power source board 41 and the control board 42 are vertically installed in the shield casing 43.

Figure 6:
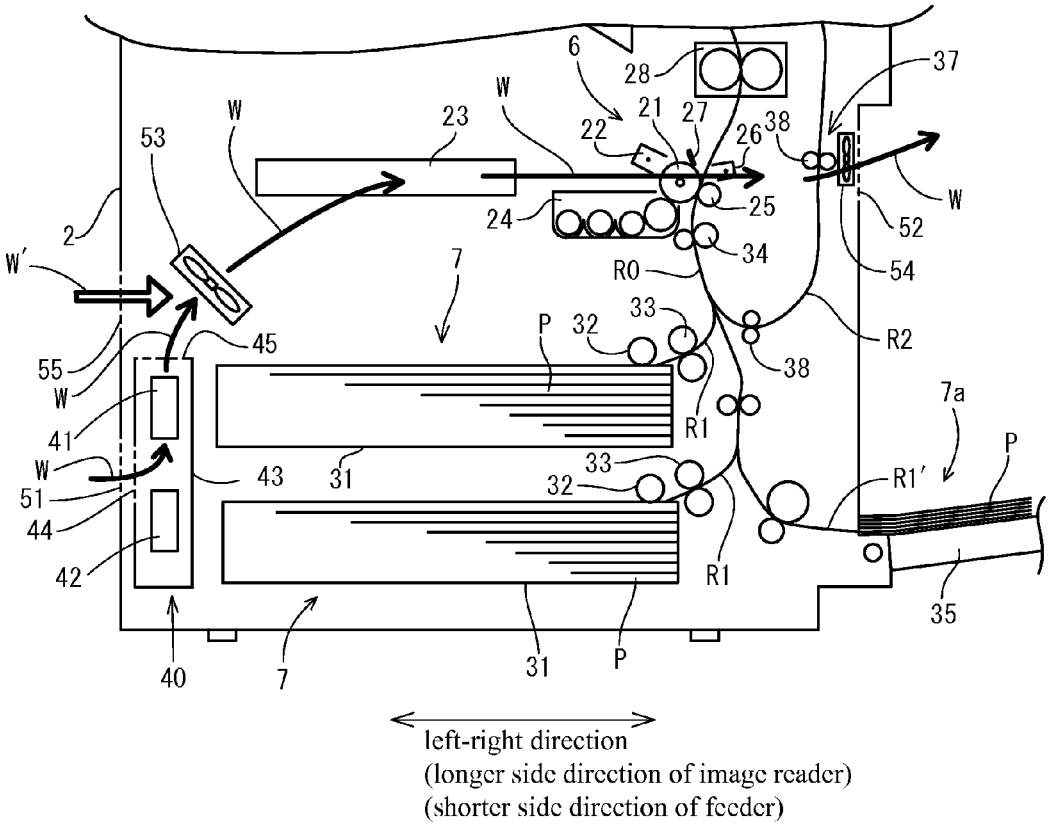
FIG. 6 is a cross-sectional enlarged front view of the inner structure of the main body.

As shown in FIG. 4 and FIG. 6, a left side plate of the main body 2 includes an intake hole 51 facing the electrical component unit 40. A right side plate of the main body 2 includes an exhaust hole 52 facing the transfer roller 25 and the duplex conveyance roller 38 at an intermediate portion of the circulation conveyance path R2. A left side plate of the shield casing 43 constituting the electrical component unit 40 includes a casing side intake hole 44 for taking in outer air entered through the intake hole 51. An upper surface plate of the shield casing 43 includes a casing side exhaust hole 45 for exhausting the air in the shield casing 43. A cooling fan 53 is disposed above the casing side exhaust hole 45 of the shield casing 43. In this embodiment, an exhaust fan 54 is disposed facing the exhaust hole 52 in the main body 2.

Driving rotation of the cooling fan 53 and the exhaust fan 54 makes the air in the shield casing 43 flow upward, and the air in the main body 2 flow from left to right to lower the inner pressure. Thus, the pressure difference is produced between the inside and the outside of the shield casing 43 as well as between the inside and the outside of the main body 2. Accordingly, the outer air is taken in through the intake hole 51. The air that has been taken in through the intake hole 51 and passed through the casing side intake hole 44 flows in the shield casing 43 to take heat from the power source board 41 and the control board 42, and then is guided to the exposing unit 23 through the casing side exhaust hole 45 on the upper surface plate and the cooling fan 53. Then, the air guided to the exposing unit 23 (air warmed while flowing in the shield casing 43) cools the part of the image forming unit 6 other than the exposing unit 23 (the photoreceptor drum 21, the developer 24, the transfer roller 25, and the like) and then is exhausted through the exhaust hole 52 (see the direction indicated by an arrow W in FIG. 6).

In other words, as indicated by the arrow W in FIG. 6, the air taken in through the intake hole 51 flows to pass through the electrical component unit 40, the exposing unit 23, and the part of the image forming unit 6 other than the exposing unit 23, and then is exhausted through the exhaust hole 52. Thus, the path extending from the intake hole 51 to the exhaust hole 52 through the electrical component unit 40, the exposing unit 23, and the part of the image forming unit 6 other than the exposing unit 23 is an air flow path W (path of air). Accordingly, the cooling fan 53 is located between the electrical component unit 40 and the image forming unit 6 (specifically, the exposing unit 23) in the air flow path W. The exhaust hole 52 of this embodiment is opened in the right side plate of the main body 2 to be adjacent to a portion between the transfer roller 25 and the fixing unit 28. Thus, the air passing through a portion around the image forming unit 6 also takes heat from a portion around the fixing unit 28 and then is exhausted through the exhaust hole 52 (the air flowing through the air flow path W also takes heat from the portion around the fixing unit 28).

In this embodiment, the left side plate of the main body 2 includes an air intake hole 55 at a portion facing the cooling fan 53 in addition to the intake hole 51. The outer air taken in through the air intake hole 55 is guided to the cooling fan 53 without passing through the electrical component unit 40, and joins the air flow path W after the exposing unit 23. Thus, the air taken in through the air intake hole 55 has a lower temperature than the air that has passed through the electrical component unit 40, thereby exhibiting high cooling effect. A path that reaches the cooling fan 53 from the air intake hole 55 without passing through the electrical component unit 40 is an air introduction path W' different from the air flow path W. The air intake hole 55, the cooling fan 53, the image forming unit 6, the exhaust fan 54, and the exhaust hole 52 are horizontally arranged approximately linearly. Accordingly, the air that does not pass through the electrical component unit 40 and thus has a low temperature flows very smoothly, and thus can exhibit high air cooling effect on the image forming unit 6.

The printing by the MFP 1 will be briefly described. The MFP 1 starts printing upon receiving a start signal, the image signal, and the like. In one-surface printing, the recording medium P fed from the feeder 7 (the sheet feed cassette 31 or the bypass tray 35) is conveyed to the image forming unit 6 through the main conveyance path R0. In the image forming unit 6, the recording medium P is conveyed to the transfer position by the pair of registration rollers 34 at the timing when the forwarding end of the toner image on the photoreceptor drum 21 reaches the transfer position, and the toner image on the photoreceptor drum 21 is transferred onto the recording medium P. After the transfer, the un-transferred toner remaining on the photoreceptor drum 21 is scraped off and removed by the cleaner 27. The recording medium P loaded with an unfixed toner image on the one surface is heated and pressed through the fixing position of the fixing unit 28, and thus the unfixed toner image is fixed. The recording medium P after having the toner image fixed (after having the one surface printed) is discharged onto the discharged sheet reservoir 8. In duplex printing, the recording medium P after having the one surface printed is conveyed to the circulation conveyance path R2 for the duplex printing to be reversed and returned to the main conveyance path R0. Thus, a toner image is transferred and fixed onto the other surface of the recording medium P.

Figure 5:
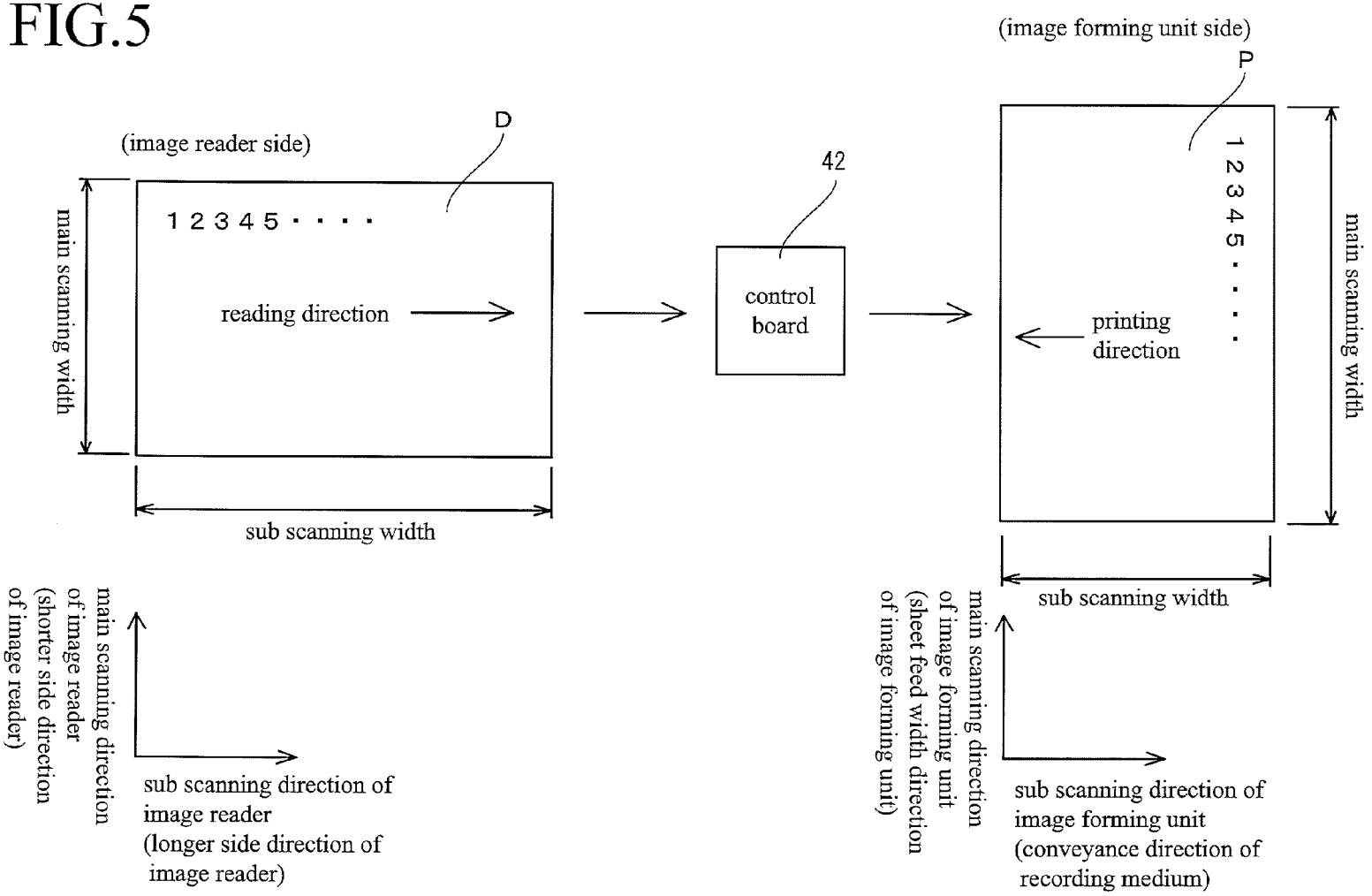
FIG. 5 is a schematic diagram illustrating an example of copying by the MFP.

Next, an example of copying by the MFP 1 will be described with reference to FIG. 5 and other figures. As described above, the light source device 13 and the mirror group 16 move in the longer side direction of the image reader 5 (left-right direction of the main body 2) to read the image on the document D placed on the platen glass 12 of the platen 11. In other words, the sub scanning direction of the image reader 5 matches the longer side direction of the image reader 5, and the main scanning direction of the image reader 5 matches the shorter side direction of the image reader 5.

The image reader 5 of this embodiment allows the document D of A4 size as the maximum size to be placed on the platen glass 12 of the platen 11 with the longer side direction of the document D aligned with the longer side direction of the image reader 5 (left-right direction of the main body 2). Here, the image signal read by the image reader 5 indicates that the main scanning width is 210 mm and the sub scanning width is 297 mm. The longer side direction of the document D of A4 size placed on the platen glass 12 is orthogonal to the longer side direction of each sheet feed cassette 31 (accommodated recording medium P) and the sheet feed width direction of the image forming unit 6. In other words, the document D of A4 size on the platen glass 12 is turned by 90° from the recording medium P in each sheet feed cassette 31. The main scanning width (corresponding to the maximum sheet feed width) of the image forming unit 6 is set to 297 mm in accordance with the longer side length L of the recording medium P of A4 in landscape.

Thus, in this embodiment, when copying the document D of A4 size, which is the maximum size, placed on the platen glass 12 of the platen 11 at the same magnification, the control board 42 replaces the sub scanning direction of the digital image data obtained by reading the document D with the main scanning direction of the image forming unit 6, and replaces the main scanning direction of the digital image data with the sub scanning direction of the image forming unit 6. The image forming unit 6 performs printing based on the replaced digital image data. In other words, the digital image data obtained by reading the document D is turned by 90° and the image forming unit 6 prints the toner image corresponding to the turned digital image data on the recording medium P of A4 in landscape (see FIG. 5). It is matter of course that the setting on the printing magnification (same magnification, enlarged, reduced, and the like) is received through the operation panel 9 or a network.

In the above-described structure, the MFP 1 includes the feeder 7 and the image forming unit 6. The feeder 7 has the longer side direction orthogonal to the conveyance direction of the recording medium P so that the maximum size recording medium P can be fed with the longer side first. The image forming unit 6 has the maximum sheet feed width corresponding to the longer side length L of the maximum size recording medium P and prints the toner image corresponding to the digital image data onto the recording medium P. Thus, the recording medium P of the maximum size is conveyed along the shorter side direction to be printed.

Thus, if the process speed of the MFP 1 is the same, driving time of the image forming unit 6 and the like can be largely shortened compared with a conventional case where the recording medium P is conveyed along the longer side direction. Accordingly, energy consumed by using electricity as well as noise can be reduced, and thus, the environmental load can be reduced. Moreover, if the process speed is the same, the number of printed sheets per unit time can be increased because the time for conveyance for the shorter side length N is the only time required for printing. Furthermore, if the consumed power is the same, the process speed can be increased and the printing performance of the MFP 1 can be improved compared with the conventional case.

In summary, the MFP 1 of this embodiment can reduce the environmental load throughout the life cycle compared with the conventional case with the same process speed, and can improve printing performance compared with the conventional case with the same power consumption.

Particularly, the MFP 1 of this embodiment is a so-called A4 compatible printer, and thus an image forming unit same as that used in a conventional A3 compatible printer for example can be directly used. Accordingly, the image forming unit 6 needs not be newly designed for the A4 compatible printer. Thus, the development period and the development cost can be shortened and reduced. Moreover, the common parts can be shared among a plurality of types of apparatuses. This contributes to the reduction of manufacturing cost.

In this embodiment, the MFP 1 further includes the image reader 5 having the shorter side direction aligned with the sheet feed width direction of the image forming unit 6 and the longer side direction of the feeder 7, so that the longer side direction of the maximum size document D on the platen 11 is orthogonal to the sheet feed width direction of the image forming unit 6 and the longer side direction of the feeder 7. Thus, the open spaces S can be respectively provided in front of and behind the image reader 5 in the shorter side direction due to the longer side direction of the feeder 7. The open space S can be utilized to dispose the operation panel 9 for input operation and the like within the occupation area of the MFP 1 (without sticking out) for example. This can provide a compact and thus favorably viewed design.

In this embodiment, the longer side direction of the image reader 5 matches the sub scanning direction. To copy the document D of the maximum size on the platen 11 at the same magnification, the image forming unit 6 performs printing by replacing the sub scanning direction of the digital image data obtained by reading the document D with the main scanning direction of the image forming unit 6, and replacing the main scanning direction of the digital image data with the sub scanning direction of the image forming unit 6. Thus, unlike in the conventional case where the recording medium P is conveyed along the longer side direction, the time required for conveyance for the shorter side length N is the only time required for printing after the document D is read. Thus, the printing performance for copying the document D of the maximum size at the same magnification can be improved.

Furthermore, in this embodiment, in the plan view, the main body 2 partially overlaps with the image reader 5, and sticks out at least from the closer longer side of the image reader 5. The sheet discharged space (discharged sheet reservoir 8) to which the printed recording medium P is discharged is formed between the main body 2 and the image reader 5. Thus, the image reader 5 needs not to cover a large area of the discharged sheet space, and whether the printed recording medium P is in the discharged sheet space can be easily confirmed visually from the sticking out side of the main body 2. Therefore, the risk of forgetting to take out and leaving the printed recording medium in the discharged sheet space can be reduced.

In this embodiment, the image forming unit 6 and the electrical component unit 40 are respectively disposed on both sides of the feeder 7 in the shorter side direction. Thus, a vacant space formed on the opposite side of the image forming unit 6 across the feeder 7 can be utilized as a portion in which the electrical component unit 40 is disposed because the recording medium P is conveyed with the longer side first. Thus, a wasteful space in the MFP 1 can be reduced, and the MFP 1 as a whole can be downsized. Moreover, the feeder 7 disposed between the image forming unit 6 and the electrical component unit 40 can prevent the heat generated in the electrical component unit 40 from adversely affecting the image forming unit 6. Furthermore, the electrical component unit 40 is disposed apart from the image forming unit 6 and thus does not hinder operations such as jam clearance.

The electrical component unit 40 of the first embodiment is vertically installed on the outer side of the other longer side of the vertically stacked sheet cassettes 31 in the main body 2. Thus, the heat generated in the electrical component unit 40 can be released upward by natural convection. Moreover, the intake hole 51 and the exhaust hole 52 are respectively formed on the right side plate closer to the electrical component unit 40 and the left side plate closer to the image forming unit 6 in the main body 2. The main body 2 incorporates the air flow path W extending from the intake hole 51 to the exhaust hole 52 through the electrical component unit 40 and the image forming unit 6, and the cooling fan 53 disposed between the electrical component unit 40 and the image forming unit 6 in the air flow path W. Thus, the heat released upward from the electrical component unit 40 by natural convection can be smoothly conveyed by air flowing through the air flow path W. Accordingly, heat radiation efficiency can be improved.

Moreover, the right side plate closer to the electrical component unit 40 in the main body 2 includes the air intake hole 55 in addition to the intake hole 51. The main body 2 includes the air introduction path W' extending from the air intake hole 55 to the cooling fan 53 without passing through the electrical component unit 40 in addition to the air flow path W. Thus, the air that does not pass through the electrical component unit 40 and thus having a low temperature can be more guided to the image forming unit 6, and thus, cooling effect on the image forming unit 6 can be improved.

It will be appreciated that the present invention will not be limited to this embodiment described above and can be embodied in various other forms. For example, while the MFP 1 has been described as an exemplary image forming apparatus, this should not be construed in a limiting sense. Other possible examples include printers.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An image forming apparatus comprising:

a feeder having a longer side direction orthogonal to a conveyance direction of a recording medium, and configured to feed a maximum size recording medium with a longer side first;

an image forming unit having a maximum sheet feed width corresponding to a longer side length of the maximum size recording medium, and configured to print a toner image corresponding to digital image data onto the recording medium;

an electrical component unit configured to control the feeder and the image forming unit;

a main body incorporating the feeder, the electrical component and the image forming unit, in which, the image forming unit and the electrical component unit are respectively disposed on opposite sides of the feeder in a shorter side direction;

a first intake hole formed in the side plate of the main body closer to the electrical component unit;

an exhaust hole formed in the side plate of the main body closer to the image forming unit;

an air flow path extending from the first intake hole to the exhaust hole through the electrical component unit and the image forming unit;

a cooling fan disposed between the electrical component unit and the image forming unit in the air flow path; and a second intake hole, different from the first intake hole, formed in the side of the main body closer to the electrical component unit, wherein the main body comprises an air introduction path extending from the second intake hole to the cooling fan without passing through the electrical component unit in addition to the air flow path.

2. The image forming apparatus according to claim 1, wherein the image forming unit is disposed above one longer side of the feeder, and wherein the electrical component unit is disposed on an outer side of the other longer side of the feeder.

3. The image forming apparatus according to claim 1 wherein the feeder comprises a plurality of vertical stacked sheet feed cassettes each configured to accommodate the recording medium, and wherein the electrical component unit is vertically installed on an outer side of the other longer side of the sheet feed cassettes in the main body.

4. The image forming apparatus according to claim 1, wherein the image forming unit comprises an exposing unit configured to expose a surface of an image carrier to form an electrostatic latent image on the surface, wherein the air flow path extends from the first intake hole to the exhaust hole through the electrical component unit, the exposing unit and the part of the image forming unit other than the exposing unit.

5. The image forming apparatus according to claim 1, wherein the feeder comprises a removable sheet feed cassette, wherein the recording medium is accommodated within a frame body of the sheet feed cassette, and wherein a length of the frame body in a conveyance direction of the recording medium is smaller than a length of the frame body in a direction orthogonal to the conveyance direction.

6. An image forming apparatus comprising:

a feeder configured to feed a recording medium;

an image forming unit configured to print a toner image corresponding to digital image data onto the recording medium;

an electrical component unit configured to control the feeder and the image forming unit;

a main body incorporating the feeder, the electrical component and the image forming unit, in which the image forming unit and the electrical component unit are respectively disposed on opposite sides of the feeder;

a first intake hole formed in the side plate of the main body closer to the electrical component unit;

a second intake hole, different from the first intake hole, formed in the side plate of the main body closer to the electrical component unit in the main body;

an exhaust hole formed in the side plate of the main body closer to the image forming unit, wherein the main body comprises an air flow path extending from the first intake hole to the exhaust hole through the electrical component unit and the image forming unit; and a cooling fan disposed between the electrical component unit and the image forming unit in the air flow path, wherein the main body further comprises an air introduction path extending from the second intake hole to the cooling fan without passing through the electrical component unit.

* * * * *